United States Patent [19]

Kopplin

[11] 4,149,054

[45] Apr. 10, 1979

[54] DISCONNECT SWITCH FOR METAL-ENCAPSULATED HIGH-VOLTAGE SWITCHING INSTALLATIONS

[75] Inventor: Horst Kopplin, Berlin, Fed. Rep. of Germany

[73] Assignee: Siemens Aktiengesellschaft, Munich, Fed. Rep. of Germany

[21] Appl. No.: 870,066

[22] Filed: Jan. 17, 1978

[30] Foreign Application Priority Data

Jan. 31, 1977 [DE] Fed. Rep. of Germany ..... 2704389

[51] Int. Cl.[2] ..... H01H 9/20; H01H 9/30; H01H 9/48

[52] U.S. Cl. ..... 200/318; 200/148 R

[58] Field of Search ..... 200/245, 247, 250, 290, 200/304, 48 R, 324, 325, 149 B, 148 R, 149 R, 146 A, 144 AP, 318

[56] References Cited

U.S. PATENT DOCUMENTS

| | | | |
|---|---|---|---|
| 2,856,480 | 10/1958 | Westerhoff | 200/250 |
| 3,939,317 | 2/1976 | Noack et al. | 200/148 R |
| 4,080,521 | 3/1978 | Goedecke et al. | 200/148 R |

FOREIGN PATENT DOCUMENTS

| | | | |
|---|---|---|---|
| 1218585 | 1/1967 | Fed. Rep. of Germany | 200/148 R |

*Primary Examiner*—Richard E. Aegerter
*Assistant Examiner*—John W. Shepperd
*Attorney, Agent, or Firm*—Kenyon & Kenyon, Reilly, Carr & Chapin

[57] ABSTRACT

A disconnect switch for use with a metal-encapsulated high-voltage switching installation wherein the switch comprises a movable switching pin and a mating contact axially associated therewith. The switch is further provided with a tube of insulating material arranged in surrounding sliding relationship to the switching pin and with a spring means braced against the pin for applying a force to the tube. Latching means is also provided for latching the tube against the force of the spring means in the on and off positions of the switch. The latter means further cooperates with an unlatching means which, during the course of the movement of the switching pin to close the switch, releases the latching means, thereby causing the tube to bridge the gap between the mating contact and the pin before the latter elements make metallic contact.

6 Claims, 1 Drawing Figure

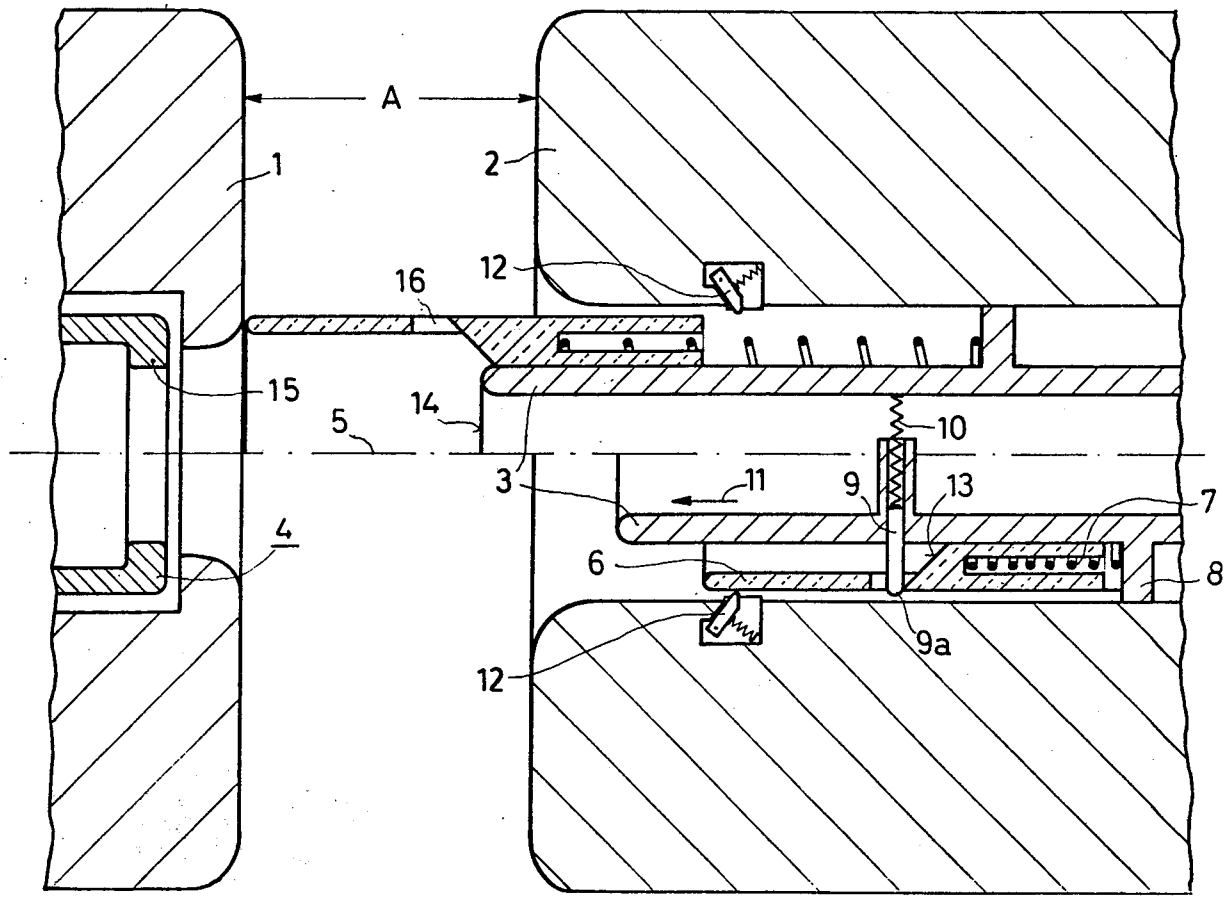
7
8
10
13
9a
9
11
6
2
12
3
12
16
14
A
5
1
15
4

DISCONNECT SWITCH FOR METAL-ENCAPSULATED HIGH-VOLTAGE SWITCHING INSTALLATIONS

BACKGROUND OF THE INVENTION

1. Field of the Invention

This invention relates to a disconnect switch for use with a metal-encapsulated high-voltage switching installation wherein the switch comprises a movable switching pin and a mating contact axially associated therewith.

2. Description of the Prior Art

In disconnect switches of the above type, the movable switching pin is actuated by a motor drive, which requires between 5 to 10 seconds to close the switch. The actual closing time depends on the size of the gap between the switching pin and the mating contact which, in turn, is a function of the nominal voltage.

If a disconnect switch of this type is closed, a preliminary breakdown with a subsequent arc of low current always occurs, if the disconnect switch is operated under voltage. In such case, the burning time of the preliminary arc may be several seconds. For disconnect switches which are suitable for voltages of up to 245 kV, the preliminary breakdown distance is so small, especially if sulfur hexafluoride is used as the quenching and insulating medium of the metal-encapsulated installation, that the arc is not expected to wander off while it burns.

On the other hand, in disconnect switches for voltages higher than 245 kV, the preliminary breakdown distance is larger so that there exists a definite danger that the preliminary arc may wander from its point of origin to the grounded encapsulation of the installation.

It is, therefore, an object of the present invention to provide a disconnect switch suitable for operation at voltages above 245 kV which does not suffer from the above disadvantage.

SUMMARY OF THE INVENTION

In accordance with the principles of the present invention, the above and other objectives are accomplished in a disconnect switch of the above type by further including therein a tube of insulating material arranged in sliding surrounding relationship to the switching pin, and spring means braced against the pin for applying a force to the tube. The switch is also provided with a latching means for latching the tube against the force of the spring in the on and off positions of the switch. The latter means, in turn, cooperates with an unlatching means in the form of a stationary pawl which, during the course of movement of the switching pin to close the switch, releases the tube, thereby causing the tube to bridge the gap between the switching pin and mating contact prior to these elements making metallic contact.

With the disconnect switch so designed, the insulating tube can be moved to bridge the gap with a relatively low velocity during the switch closing time (closing time about 200 msec), before a gap length favorable for a preliminary arc is reached. The spring forces, thus, can be kept small and the latching arrangement can be kept simple and lightweight.

A particularly advantageous embodiment of the invention is obtained if a shielding electrode is employed in surrounding relationship to the movable switching pin and the stationary pawl is supported in the electrode. In such case, the latching means can take the form of a spring-loaded pin which is guided in a transverse bore in the movable switching pin and which engages in one of its end positions a cutout provided in the insulating tube. This spring-loaded pin is placed in its second end position by action of the pawl which removes the pin from the tube cutout and causes it to engage an upwardly inclined surface portion of the tube which is adjacent the cutout and which acts as a conical run-up surface. In the on position of the switch, the spring-loaded pin can again engage the cutout of the insulating tube, thereby securely latching same when the switch is in on.

BRIEF DESCRIPTION OF THE DRAWING

The above and other features and aspects of the present invention will become more apparent upon reading the following description in conjuction with the accompanying sole drawing which illustrates schematically a disconnect switch in accordance with the principles of the present invention.

DETAILED DESCRIPTION

As shown in the drawing, the disconnect switch of the invention includes two coaxially arranged electrodes 1 and 2 which define a gap A. The electrode 2 has a concentric recess in which is movably guided a switching pin 3, which cooperates with an axially associated mating contact 4 disposed within a corresponding recess of the electrode 1. The movable switching pin 3 is driven by a motor drive with an operating time, for example, of between 5 to 10 seconds. The latter drive has not been specifically shown in the drawing to avoid unnecessary complication thereof.

In the portion of the figure shown below the center line 5, the movable switching pin 3 is in the off position. The pin is surrounded by a tube 6 of insulating material which is slidably mounted on the outer cylindrical surface of the pin. The insulating tube 6 is loaded by a spring 7, the latter spring being braced against a projecting stationary collar 8 of the switching pin 3. A pin 9 loaded by a compression spring 10, is guided in a transverse bore of the switching pin 3 and latches the insulating tube 6 against the force of the spring 7 when the switching pin is in the off position, through engagement of the tip **9*a* of the pin with a cutout 16** in the surface of the tube.

In the course of the closing motion of the switch (i.e., in the course of the movement of the pin 3 in the direction of the arrow 11), the pin 3 as well as the pin 9 and the insulating tube 6 are moved along in the direction of the arrow 11 until the tip **9*a* of the pin hits a stationary pawl 12 which is tiltably supported in the electrode 2. The pawl 12 forces the tip 9*a* of the pin 9 out of the cutout 16 and radially inward, so that it engages an inclined portion 13 of the tube 6 adjacent the slot 16. The portion 13 acts as a conical run up surface driving the pin 9 under the force of the compression spring 7 further into the interior of the pin 3, thereby unlatching the insulating tube 6**.

In the position shown above the center line 5, the insulating tube 6 has been driven by the compression spring 7 so far that it bridges the gap A. As a result, arc penetration cannot occur prior to the switching pin 3 being spaced from the mating contact 4 of the electrode 1 such that it favors a preliminary breakdown.

In the course of the further closing motion, the free end 14 of the switching pin 3 engages the contact fingers 15 of the mating contact 4. This movement, in turn, again brings the tip 9*a* of the spring-loaded pin 9 into engagement with the cutout 16 of the insulating tube 6, so that in the closed position of the switch the tube 6 is again latched relative to the switching pin 3.

During the opening motion of the switch in the direction opposite to the arrow 11, the free end 9*a* of the pin 9 is not acted upon by the pawl 12, which gives in this direction. To this end, the pawl is spring-loaded.

What is claimed is:

1. A disconnect switch for use in a metal encapsulated high-voltage switching installation comprising:

a movable switching pin;

a mating contact axially associated with said switching pin;

a tube of insulating material arranged in surrounding relationship to said switching pin;

spring means braced against said switching pin for applying a force to said tube;

means for latching in the on and off position of said switch said tube against the force of said spring;

and means for unlatching said latching means during the course of movement of said switching pin to bring said switch into the on position, thereby causing said tube to bridge the gap between said switching pin and said mating contact before said switching pin makes metallic contact with said mating contact, whereby said gap is enclosed and arc penetration therefrom prevented.

2. A disconnect switch in accordance with claim 1 wherein:

said means for unlatching includes a stationary pawl.

3. A disconnect switch in accordance with claim 2 wherein:

said switch further includes a shielding electrode in surrounding relationship to said switching pin;

and said stationary pawl is supported in said shielding electrode.

4. A disconnect switch in accordance with claim 3 wherein:

said switching pin has a bore transverse to its axis;

said latching means includes a spring-loaded pin which is movably guided in said bore transverse to said axis;

said insulating tube includes a cutout for receiving said spring-loaded pin when said pin is in a first end position and said stationary pawl is arranged to act on said pin during the movement of said switching pin to bring said switch into the on position.

5. A disconnect switch in accordance with claim 4 wherein:

the surface of said tube adjacent said cutout is upwardly sloped to form a conical run-up surface on which the spring-loaded pin travels to a second end position after said spring-loaded pin is acted upon by said pawl.

6. A disconnect switch in accordance with claim 5 wherein:

in the on position of said switch said spring-loaded pin returns to its first end position and engages said cutout of said tube.

* * * * *